United States Patent [19]

May

[11] Patent Number: 4,739,992

[45] Date of Patent: Apr. 26, 1988

[54] BOARD GAME INCLUDING BOARD WHOSE PLAYING SURFACES ARE RELATED

[76] Inventor: Richard W. May, 463 Beacon St., Boston, Mass. 02115

[21] Appl. No.: 937,163

[22] Filed: Dec. 2, 1986

[51] Int. Cl.[4] ..... A63F 3/00

[52] U.S. Cl. ..... 273/243; 273/291; 273/287

[58] Field of Search ..... 273/261, 284, 260, 287, 273/243

[56] References Cited

U.S. PATENT DOCUMENTS

| | | | |
|---|---|---|---|
| 534,080 | 2/1895 | Preston | 273/261 |
| 1,623,881 | 4/1927 | Mayer | 273/261 |
| 3,920,247 | 11/1975 | Jenkins | 273/261 |
| 4,043,559 | 8/1977 | Eigen et al. | 273/284 |
| 4,653,759 | 3/1987 | Anderson et al. | 273/261 |

FOREIGN PATENT DOCUMENTS

| | | | |
|---|---|---|---|
| 324361 | 9/1902 | France | 273/261 |
| 1590442 | 6/1981 | United Kingdom | 273/284 |

*Primary Examiner*—Matthew L. Schneider

*Attorney, Agent, or Firm*—Sughrue, Mion, Zinn, Macpeak, and Seas

[57] ABSTRACT

A multiple board game apparatus comprises a board with first and second playing surfaces and a plurality of identical game pieces for playing a multiple number of board games. The first surface of the board is divided into triangles and the second surface is divided into hexagons. The vertexes of the triangles on the first surface form points of intersection. The total number of points of intersection on the first surface are equal in number to the total number of hexagons on the second surface. The level of difficulty of each game can be varied by playing on either the first or second side. The game pieces have a directional feature, a substantial thickness and are reversible to provide dual identification for each piece.

8 Claims, 3 Drawing Sheets

FIG. 1
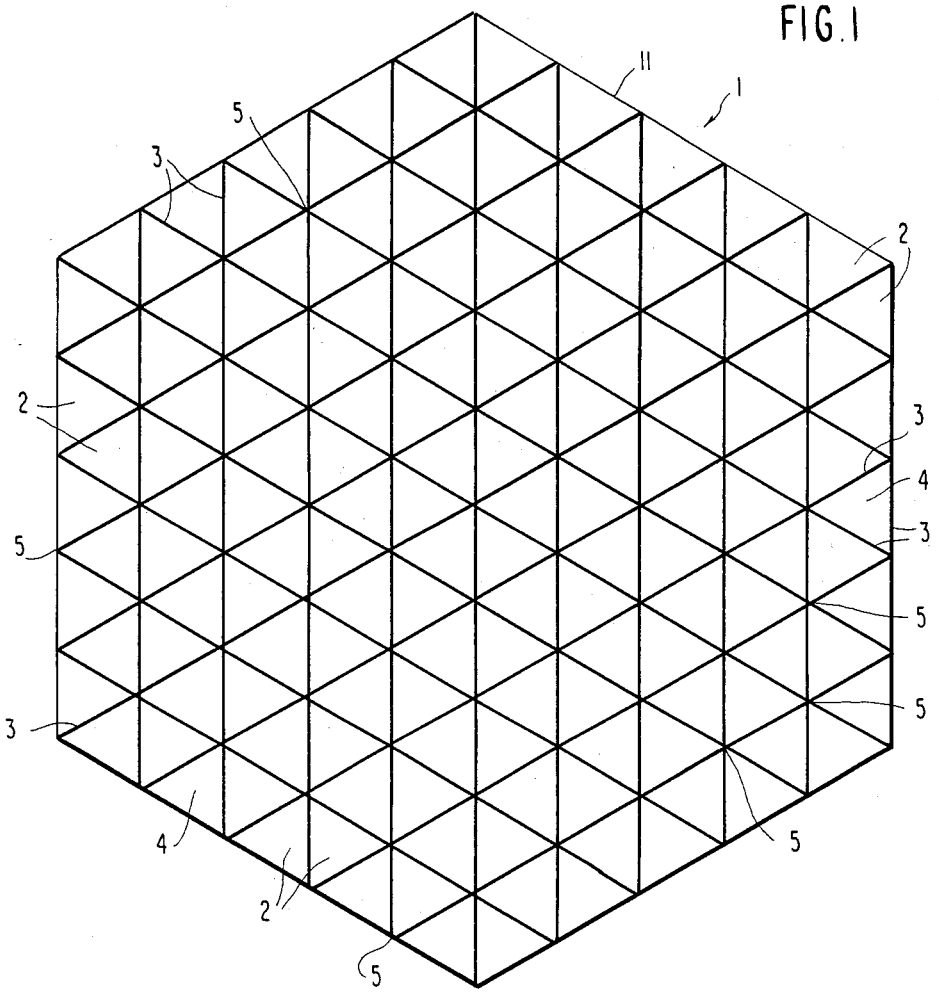
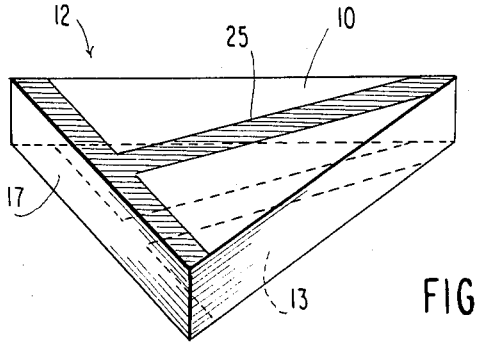
FIG. 3

FIG. 2
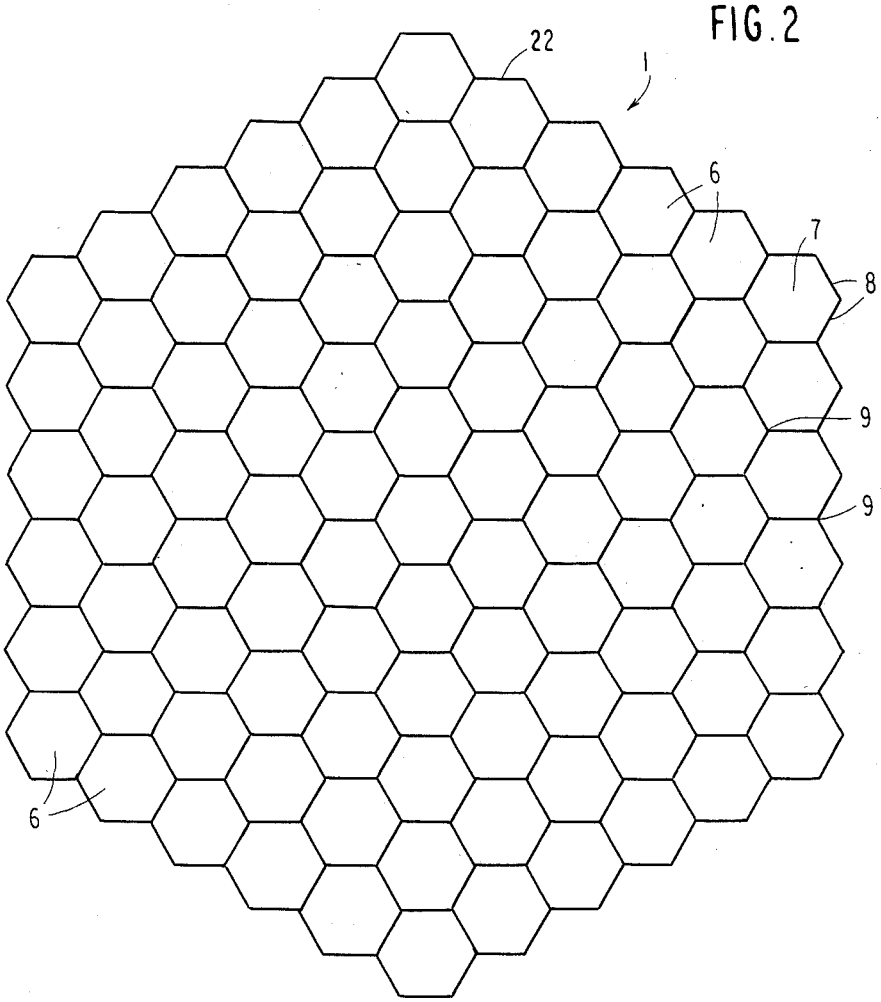
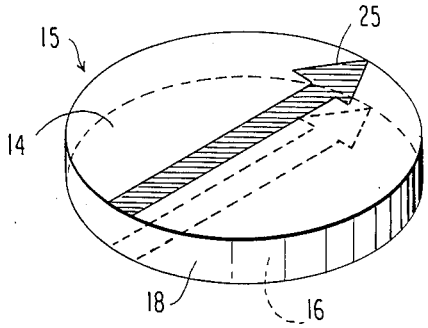
FIG. 4

BOARD GAME INCLUDING BOARD WHOSE PLAYING SURFACES ARE RELATED

BACKGROUND OF THE INVENTION

The present invention relates to games of amusement and, in particular, to a game board having pieces for playing a multiple number of games with the level of skill and complexity for each game capable of being varied to suit the players.

Strategic board games having pieces which are moved about playing spaces on the board have long been known, with the object often being ultimately to capture all of the opponents pieces or blocking the opponent so that there are no more moves available.

Games such as checkers are easy to learn and understand, as well as inexpensive to manufacture because the playing pieces are identical. On the other hand, games such as chess require a higher level of skill and strategy and are more expensive to manufacture because of the various shaped playing pieces.

Many board games are capable of being used for only a single game using no more than two players and involve a level of skill that cannot readily be varied without substantially changing the character of the game.

SUMMARY OF THE INVENTION

The present invention provides a novel and unique game board and game pieces for playing a multiple number of games. The hexagonally shaped game board is reversible, having a first side divided into triangular shaped areas while the second side is divided into hexagonally shaped areas. Each area has a common side with an adjacent area and the pieces can be moved from point to point along the lines in one embodiment or from area to area in another embodiment. When the game pieces are set up on the points of the first side of the game board, there are six possible directions of movement, and when the pieces are set up on the points of the second side of the board there are only three possible directions of movement. This smaller number of possible moves simplifies the play of each game.

The game pieces of the present invention are stackable, reversible and directional. The pieces are preferably wedge shaped or disk shaped and are inexpensive to manufacture. The game pieces have two opposite sides which are of a different color, each color representing a respective opponent. Thus, when a player captures an opponent's piece the piece is flipped over and becomes the color of the captor's side. The pieces may be stacked to indicate that they have increased power or greater range of movement in accordance with the particular rules for each game. The pieces are directional in that the pieces may have an asymetrical shape or may be provided with an arrow or marking indicative of direction which will indicate if a piece has been promoted to a piece having greater power.

Accordingly, it is a feature of the present invention to provide a game board and game pieces that can be used to play a number of different board games that can be played by one, two, or more than two people.

Another feature of the present invention is to provide a game board that is reversible with each side capable of playing each game without substantially varying the rules but providing different levels of skill between the two sides.

Another feature of the present invention is to provide a multiple board game apparatus of skill and strategy that can also be played with a single die to add a chance version to each game.

These and other features of the present invention will become readily apparent from the following detailed description, taken with reference to the accompanying drawings.

BRIEF DESCRIPTION OF THE DRAWINGS

FIG. 1 is a top plan view of a first side of a game board embodying the present invention.

FIG. 2 is a top plan view of a second side of a game board embodying the present invention.

FIG. 3 is a perspective view of a playing piece having two flat triangular sides.

FIG. 4 is a perspective view of a playing piece having two flat circular sides.

DETAILED DESCRIPTION OF THE INVENTION

Figure 5:
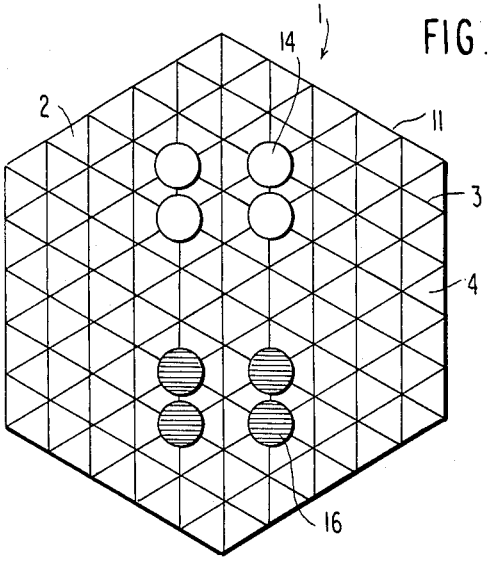
FIGS. 5 and 6 are each top plan views in FIG. 1, illustrating game pieces set up for an exemplary game showing various levels of difficulty of play.

A game board according to the present invention comprises a geometrically shaped board formed of any suitable material such as cardboard. The game board is reversible and can be used to play a multiple number of games. FIGS. 1 and 2 illustrate the two playing surfaces of the present invention.

Referring to FIG. 1, a six sided or hexagonally shaped game board 1 is shown. FIG. 1 depicts a first playing surface 11 of the game board which is divided into a plurality of equilateral triangles 2. The triangles are symmetrical and contiguous with each triangle having a common side with each adjacent triangle. Each triangle, having a space or area 4, being defined by the sides 3, form three vertices or points of intersection 5. In the preferred embodiment of the board game one hundred fifty triangles form ninety-one points of intersection. The game pieces, to be described later, can move from space to space, or alternatively, from point to point along the sides of the triangles depending upon the game to be played and the desired level of skill. Thus, a game piece placed on a point of intersection on side 1 of the game board can move in six possible directions along the lines radiating from an interior point of intersection 5.

FIG. 2 depicts the reverse side of the hexagonally shaped game board 1 shown in FIG. 1. A second playing surface 22 of the game board is divided into a plurality of identical hexagons with each hexagon sharing a common side with each adjacent hexagon. Each hexagon has a space or area 7 defined by sides 8 which form six vertices or points of intersection 9. If the game pieces are set up on the points of intersection on the second surface there are only three possible directions of movement.

In the present invention the number of points of intersection 5 on the upper surface 1 equals the number of hexagons 6, and in the preferred embodiment, that number is ninety-one. Likewise, the number of triangles 2 on the first side equals the number of points of intersection 9 on the second surface, with that number being one hundred fifty in the preferred embodiment. Because the points of intersection of one side correspond to the spaces of the other side, each game played according to the rules can be played on either side of the game board. However, according to one of the features of the invention, the rules and character of the game can be maintained while the level of skill and strategy can be varied. For example, if the game is played on the first surface 11 with the pieces placed on the points, each piece has six possible directions of movement and, when the rules permit, may move in a linear direction along a plurality of points. However, if the same game is played on the second surface 22 and the pieces are placed on the points, each piece can move in only three possible directions between only two points because the points are not linearly aligned. The reduced freedom of movement simplifies the game and requires a lower level of skill and strategy.

Figure 8:
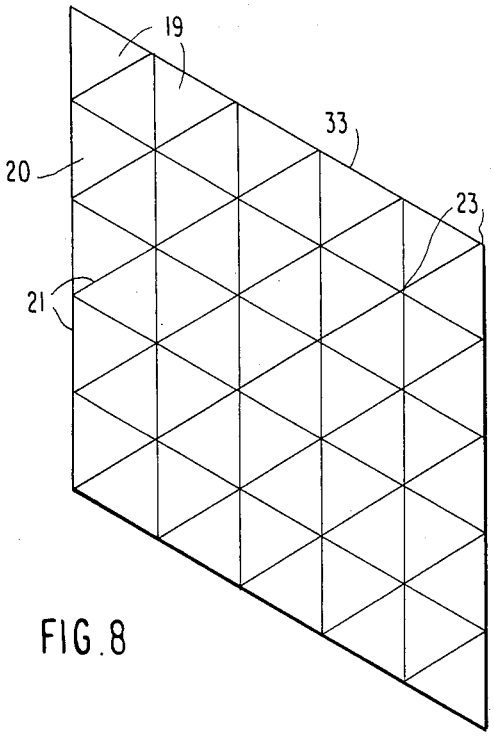
FIG. 8 is a top plan view of a first side of a game board showing a second embodiment of the invention.

FIG. 8 depicts a game board of the second embodiment of the invention. A rhombus shaped board 33 is shown having a first playing surface 33 with the essential features as disclosed in FIG. 1. The playing surface 33 is divided into a plurality of equilateral triangles 19. Each triangle, having spaces 20 defined by sides 21, forms three vertices or points of intersection 23. The rhombus shaped board can be a separate game board or could be formed by sectioning off the appropriate parts of the hexagonally shaped board.

The game pieces are illustrated in FIGS. 3 and 4. Referring to FIG. 3, a game piece 12 is depicted. The game board utilizes many game pieces in playing the variety of games with the number of pieces used depending on the game to be played and the desired level of skill. The game piece comprises two flat parallel triangular sides 10 and 13 which enable the pieces to easily be stacked. Between the sides is disposed a filler material 17 of styrofoam or any suitable material capable of giving the game piece a substantial thickness so when the pieces are stacked the number of pieces in each stack can be readily ascertained. FIG. 4 illustrates a game piece 15 which has two flat parallel circular sides 14 and 16 with a filler material 18 disposed therebetween. Each game piece includes direction defining means which comprise some type of marking such as an arrow 25 on each side of the piece. Directionality may also be achieved by the inherent, spatial asymmetry of the piece, for example, as in an isoseles triangle (having only two equal sides), with the axis of symmetry indicating direction of movement. The direction of each game piece is an indication of its power and movement capabilities which vary depending on the rules of each game.

Each game piece also contains dual identification which enables it to be used by either opponent. Indicating means showing possession could, for example, comprise side 14 of game piece 15 being of one color and side 16 being of another color, with each opponent being assigned to one of the colors. When one player captures a game piece of an opponent the change of possession can simply be illustrated by flipping over the game piece.

The board game apparatus of the present invention can be used to play a multiple number of games. Presently the rule book which accompanies the game board apparatus discloses eighteen different games to be played with many games including one or more variations. The rules are such that each game can be played on either the points or the spaces of both surfaces of the game board, and as discussed above, one way of increasing the level of skill and strategy of each game is to play on the points of the first surface as opposed to playing on the points of the second surface. The difficulty of play of each game can also be varied by using a smaller area of the board with a reduced number of points and pieces. This results in a lower level of difficulty and strategy and can likewise speed up the duration of the game.

Figure 7:
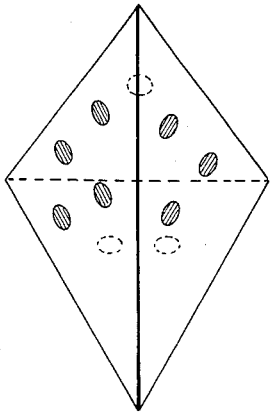
FIG. 7 is a perspective view of a tetrahedral die.

All games may be played with a chance version in which the tossing of a single tetrahedral die, as shown in FIG. 7, determines the number of pieces played or moved per turn.

Figure 6:
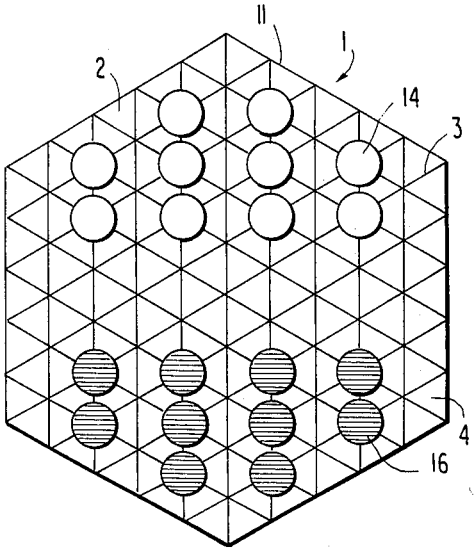

An exemplary game of the multiple board game apparatus will now be disclosed to illustrate the features of the present invention. The game is arbitrarily called "Hypercheckers" and is played on the first surface 11 of the game board using all ninety-one points. FIG. 5 and 6 depict the starting position of the pieces on the game board at two different levels of play. One player will be assigned to the white pieces and the other to the black pieces.

The pieces may be moved, one piece per turn, in one straight line in any of the six directions to another point either occupied by a piece of either color or to an unoccupied point. A move consists of moving a stack of pieces as many points as there pieces in the stack. At the beginning of the game all the stacks are one piece high so a piece can only be moved to an adjacent point, only one space over. A stack two pieces high can be moved in one straight line to a point two spaces distant. Similarly stacks of threee, four, or n- pieces may be moved three, four, or n-units of distance to a new point, either occupied or unoccupied.

The color of the uppermost piece in the stack determines which player controls the entire stack. A stack may be moved over intervening points whether they are unoccupied or occupied by a stack or stacks controlled by the player making the move. Stacks passed over are not in any way changed or influenced. A move of a piece may end on either an unoccupied point or on a stack controlled by either player. If a player moves one of the stacks onto a point occupied by a stack controlled by the opponent, then the resulting combined stack is under control of the player making the move because the uppermost piece of the new stack is a piece of that player's color.

An unpromoted stack cannot be moved over other stacks controlled by the opponent. A stack is promoted if it reaches the points of the initial position of the opponent's pieces. The promotion of the pieces is indicated by reversing the directional means of the game piece so that the arrow or triangle points in a direction opposite to the direction of the directional means of unpromoted pieces. Such a promoted stack can now move over stacks controlled by the opponent. The range of movement of a promoted stack is equal to or less than three times the number of pieces in the stack. A player who controls a stack may make a move of fewer units than the total number of pieces in the stack. This is done by lifting as many pieces from the top of the stack as the number of units a player intends to move. The remaining pieces in the stack stay where they are.

There is no maximum number of a player's own pieces which may be contained within a stack, hence stacks can be made of any height with no upper limit. However, a stack is permitted to have a maximum of two opponent's pieces within it. If a move is made causing a stack to form having more than two opponent's pieces within it, then all of the opponent's pieces in excess of two within the stack are removed from the lower portion of the stack and are considered captured and taken from the board by the player making the move. Captured pieces are captured as individual pieces, i.e., stacks of one piece, not stacks of more than one piece, regardless of their number and arrangement in the stack from which the pieces are removed. The additional pieces belonging to the player making the move remain within the stack. There is no capturing by jumping in "Hypercheckers".

Captured pieces can be used by the capturing player against their original owner. A captured piece may be reinstated on any turn of the capturing player at any point of the board, either unoccupied or occupied by a stack under control of either player. If a player reinstates one of his captured pieces onto a point occupied by a stack under the control of an opponent, then the resulting combined stack is under control of the player making the move because the uppermost piece of the new stack is a piece of that player's color. The re-entering of a captured piece by the captor constitutes a turn. Such a piece reinstated by the captor is called a paratroop or drop, because of its actual descent onto the board from the side. Dropped pieces must be identifiable visually as now belonging to the opponent (i.e., captor) and not the original owner, i.e., the game piece must be reversed. A captured promoted piece loses its promoted status, and if reinstated, is dropped into the game as an unpromoted piece. If the dropped piece is reinstated on its promotion points (the points of the initial position of the opponent's pieces) it may be promoted on its next move.

The object of the game is to make it impossible for an opponent to legally move by having all the stacks controlled by a player's own pieces and/or by blocking the remianing stacks of the opponent so they cannot move.

While preferred embodiments of the invention have been shown and described, various other embodiments and modifications thereof will become apparent to persons skilled in the art, and will fall within the scope of the invention as defined in the following claims.

What is claimed is:

1. A multiple game apparatus comprising:

a reversible board having a hexagonal configuration and having first and second playing surfaces on opposite sides of said board, said first surface being divided into a plurality of triangles with each triangle comprising an enclosed space defined by three equilateral sides and having a common side with each adjacent triangle and points of intersection formed at each vertex of each triangle, said second playing surface being divided into a plurality of hexagons with each hexagon comprising an enclosed space defined by six equilateral sides and having a common side with each adjacent hexagon and points of intersection formed at each vertex of each hexagon; and a plurality of identically shaped game pieces having first and second flat parallel surfaces;

the total number of said points of intersection of said first playing surface being equal in number to the total number of hexagons on said second playing surface whereby the level of skill and strategy is different for the same game played on said first and second playing surfaces since the game pieces played on the points of intersection of the first playing surface have six directions of possible movement along the lines radiating from a point of intersection whereas pieces played on the poiints of intersection of the second playing surface have three directions of possible movement along the lines radiating from a point of intersection.

2. A multiple game apparatus according to claim 1, wherein said first surface comprises 150 triangles and 91 points of intersection and wherein the second surface comprises 91 hexagons and 150 points of intersection.

3. A multiple game apparatus according to claim 1, further comprising a tetrahedral die having indicating means on each surface thereof for adding an element of chance to each move.

4. A multiple game apparatus according to claim 1, wherein said game pieces have indicting means for distringuishing between said first and second flat surfaces.

5. A multiple game apparatus according to claim 4, wherein said game pieces have means for defining direction.

6. A multiple game apparatus according to claim 5, wherein said game pieces have a substantial thickness allowing the number of pieces in a stack to be easily ascertained.

7. A multiple game apparatus according to claim 6, wherein said first and second flat surfaces of said game pieces are in the shape of a triangle.

8. A multiple game apparatus according to claim 6, wherein said first and second flat surfaces of said game pieces are in the shape of a circle.

* * * * *

UNITED STATES PATENT AND TRADEMARK OFFICE

CERTIFICATE OF CORRECTION

PATENT NO. : 4,739,992

DATED : April 26, 1988

INVENTOR(S) : May

It is certified that error appears in the above-identified patent and that said Letters Patent is hereby corrected as shown below:

| | |
|---|---|
| COLUMN 2, LINE 17 | Delete "in" and insert --of--; |
| COLUMN 4, LINE 30 | Delete "threee" and insert --three--; |
| COLUMN 4, LINE 30 | After "pieces" insert --high--; |
| COLUMN 6, LINE 20 | Delete "poiints" and insert --points--; |
| COLUMN 6, LINE 33 | Delete "indicting" and insert --indicating--. |

Signed and Sealed this

Sixteenth Day of May, 1989

*Attest:*

*Attesting Officer*

DONALD J. QUIGG

*Commissioner of Patents and Trademarks*